US011650515B2

(12) United States Patent
Ikami et al.

(10) Patent No.: US 11,650,515 B2
(45) Date of Patent: May 16, 2023

(54) IMAGE FORMING APPARATUS

(71) Applicant: CANON KABUSHIKI KAISHA, Tokyo (JP)

(72) Inventors: Yasukazu Ikami, Tokyo (JP); Takashi Mukai, Kanagawa (JP); Shuhei Tokiwa, Tokyo (JP); Taichi Sato, Kanagawa (JP); Fuka Enokido, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/718,347

(22) Filed: Apr. 12, 2022

(65) Prior Publication Data

US 2022/0334509 A1 Oct. 20, 2022

(30) Foreign Application Priority Data

Apr. 16, 2021 (JP) ..... JP2021-069612

(51) Int. Cl.

| | |
|---|---|
| ***G03G 15/06*** | (2006.01) |
| ***G03G 21/00*** | (2006.01) |
| ***G03G 15/02*** | (2006.01) |
| ***G03G 15/00*** | (2006.01) |

(52) U.S. Cl.

CPC ..... *G03G 15/065* (2013.01); *G03G 15/0216* (2013.01); *G03G 15/0266* (2013.01); *G03G 15/5004* (2013.01); *G03G 15/5008* (2013.01); *G03G 21/0064* (2013.01)

(58) Field of Classification Search

CPC ..... G03G 15/065; G03G 15/0225; G03G 15/0266; G03G 15/5008; G03G 15/0216; G03G 15/50; G03G 2215/0634

See application file for complete search history.

(56) References Cited

U.S. PATENT DOCUMENTS

| | | | | |
|---|---|---|---|---|
| 8,346,109 | B2 | 1/2013 | Yamane | |
| 2002/0159782 | A1* | 10/2002 | Tsuruya | G03G 15/0216 399/176 |
| 2017/0031314 | A1* | 2/2017 | Suzuki | G03G 21/203 |
| 2019/0101859 | A1* | 4/2019 | Minagawa | G03G 21/0005 |

FOREIGN PATENT DOCUMENTS

| | | | |
|---|---|---|---|
| JP | 2004191766 | A | 7/2004 |
| JP | 1669557 | B2 | 4/2011 |

* cited by examiner

*Primary Examiner* — Jessica L Eley

(74) *Attorney, Agent, or Firm* — Rossi, Kimms & McDowell LLP

(57) ABSTRACT

Provided is an image forming apparatus, including: an image bearing member; an exposure unit; a developing member which is rotatable at a rotation speed different from the image bearing member; a developer supply member; a developing voltage-applying unit; a supply voltage-applying unit; and a control unit. The control unit controls execution of: an image forming operation in which a developer image is formed by supplying developer on the image bearing member; and a cleaning operation which removes a substance adhered to the image bearing member using the developing member. In the cleaning operation, the control unit controls the developing voltage-applying unit or the supply voltage-applying unit so that the cleaning force using the developing member becomes stronger than that in the image forming operation.

19 Claims, 4 Drawing Sheets

IMAGE FORMING APPARATUS

BACKGROUND OF THE INVENTION

Field of the Invention

The present invention relates to an image forming apparatus.

Description of the Related Art

In an image forming apparatus, an image is formed by developing an electrostatic latent image formed on the surface of an image bearing member using developer on a developer bearing member. In this image formation, a configuration of a contact developing system, which develops the image in the state of the developer bearing member contacting the image bearing member, is known. For the developer bearing member having such a configuration, a developing roller, having an elastic layer on an outer peripheral surface of a shaft center which is rotary-driven, is used.

On the other hand, in order to downsize the image forming apparatus and to reduce cost by minimizing members, an image bearing member cleanerless image forming apparatus, which does not include a cleaning unit to remove and collect toner remaining on the image bearing member, is proposed.

In the case of the cleanerless type image forming apparatus, untransferred toner and toner causing fogging directly enter between the photosensitive drum and the charging roller, hence stress may be generated between the photosensitive drum and the charging roller, and melted toner may adhere to the photosensitive drum. If melted toner is adhered, exposure may be interrupted, and blank dots may be generated in the image. Further, if the melted portions are adhered continuously to the photosensitive drum in the circumferential direction, white streaks may appear in the image.

In the cleanerless system, the developing portion needs to collect the toner that was not transferred to form the image, however the toner that melted and adhered to the photosensitive drum cannot be removed and collected unless a strong force is applied in the developing portion. Normally the developing roller is covered with a toner layer, but if the surface layer of the developing roller is exposed from the toner layer, the photosensitive drum can be scraped more strongly, whereby toner on the photosensitive drum can be removed.

Japanese Patent No. 4669557 discloses an apparatus that includes a reset mode, in which the difference of the apply voltage between a developing roller and a toner supply roller is reduced than that during printing, so as to change the toner amount on the developing roller when an image is not formed. In the apparatus disclosed in Japanese Patent No. 4669557, the toner amount on the developing roller is decreased by reducing the apply voltage difference between the developer bearing member and the toner supply roller in the reset mode, so that such a problem as fogging is not generated when the toner amount on the developing roller is increased. Thereby the toner amount on the developing roller can be maintained at a constant level for a long period.

SUMMARY OF THE INVENTION

However, Japanese Patent No. 4669557 does not disclose the difference of the peripheral speed between the developing roller and the photosensitive drum, and an object thereof is not to scrape off the melted toner adhered to the photosensitive drum. Therefore if the method disclosed in Japanese Patent No. 4669557 is directly applied, the melted toner adhered to the photosensitive drum may not be sufficiently removed, or the photosensitive drum may be excessively rubbed by the developing roller, whereby the developer may deteriorate more quickly.

With the foregoing in view, it is an object of the present invention to prevent the adhesion of melted toner to the photosensitive drum of the image forming apparatus, so as to acquire good image quality.

The present invention provides an image forming apparatus comprising:

an image bearing member configured to be rotatable;

an exposure unit configured to expose a surface of the image bearing member to form an electrostatic latent image on the surface of the image bearing member;

a developing member configured to be rotatable, which contacts with the image bearing member to form a developing portion, and supplies developer to the surface of the image bearing member in the developing portion, and which rotates at a rotation speed different from a rotation speed of the image bearing member;

a developer supply member configured to supply developer to the surface of the developing member;

a developing voltage-applying unit configured to apply developing voltage to the developing member;

a supply voltage-applying unit configured to apply supply voltage to the developer supply member; and a control unit configured to control the developing voltage-applying unit and the supply voltage-applying unit, wherein the control unit controls execution of: an image forming operation in which a developer image is formed on the surface of the image bearing member by supplying the developer from the developing member to the electrostatic latent image formed on the surface of the image bearing member; and a cleaning operation, which is an operation other than the image forming operation and which removes a substance adhered to the surface of the image bearing member, using the developing member, in the case of executing the cleaning operation, the control unit controls at least one of the developing voltage-applying unit and the supply voltage-applying unit so that the cleaning force to clean the substance adhered to the surface of the image bearing member using the developing member becomes stronger than that in the case of executing the image forming operation, and in the case of executing the cleaning operation, the control unit controls at least one of the developing voltage-applying unit and the supply voltage-applying unit so that the supply amount of the developer supplied from the developer supply member to the developing member decreases compared with the case of executing the image forming operation.

The present invention also provides an image forming apparatus comprising:

an image bearing member configured to be rotatable;

an exposure unit configured to expose a surface of the image bearing member to form an electrostatic latent image on the surface bearing member;

a developing member configured to be rotatable, which contacts with the image bearing member to form a developing portion, and supplies developer to the surface of the image bearing member in the developing portion, and which rotates at a rotation speed different from a rotation speed of the image bearing member;

a developer supply member configured to supply developer to the surface of the developing member;

a developing voltage-applying unit configured to apply developing voltage to the developing member;

a supply voltage-applying unit configured to apply supply voltage to the developer supply member; and a control unit configured to control the developing voltage-applying unit and the supply voltage-applying unit, wherein the control unit controls to be capable of executing: an image forming operation in which a developer image is formed on the surface of the image bearing member by supplying the developer from the developing member to the electrostatic latent image formed on the surface of the image bearing member; and a cleaning operation, which is an operation other than the image forming operation and which removes a substance adhered to the surface of the image bearing member, using the developing member, in the case of executing the cleaning operation, the control unit controls at least one of the developing voltage-applying unit and the supply voltage-applying unit so that the cleaning force to clean the substance adhered to the surface of the image bearing member using the developing member becomes stronger than that in the case of executing the image forming operation, and the control unit is capable of changing the cleaning force in the cleaning operation.

According to the present invention, the adhesion of melted toner on the photosensitive drum of the image forming apparatus can be prevented, so as to acquire good image quality.

Further features of the present invention will become apparent from the following description of exemplary embodiments with reference to the attached drawings.

DESCRIPTION OF THE EMBODIMENTS

Embodiments of the present invention will be described in detail using examples, with reference to the drawings. The dimensions, materials, shapes and relative positions of the components described in the embodiments may be changed appropriately in accordance with the configuration and various conditions of the apparatus to which the present invention is applied. In other words, these particulars are not intended to limit the scope of the invention to the following embodiments.

EXAMPLE 1

Overview of Image Forming Apparatus

Figure 1:
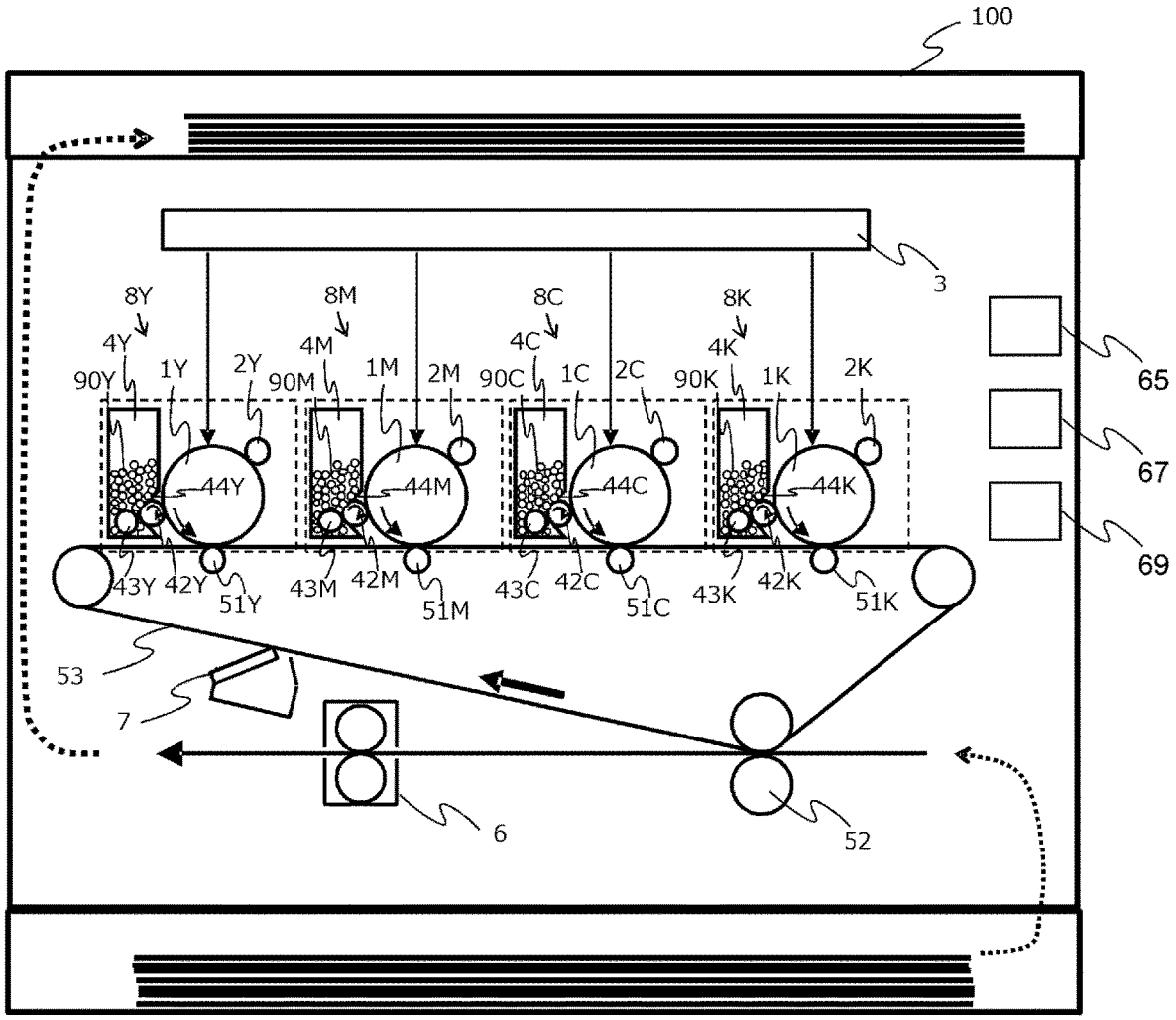
FIG. 1 is a schematic configuration diagram depicting an example of an image forming apparatus of Example 1.

A general configuration of an electrophotographic image forming apparatus (hereafter "image forming apparatus") according to Example 1 of the present invention and an image forming operation thereof will be described with reference to FIG. 1. FIG. 1 is a schematic cross-sectional view depicting a general configuration of the image forming apparatus 100 according to the embodiment of the present invention.

In the present embodiment, image forming stations (image forming units) for four colors (yellow, magenta, cyan and black) are disposed from left to right in FIG. 1. Each image forming stations has an electrophotographic image forming mechanism with identical configuration, except that the color of the developer (hereafter "toner") 90 contained in the respective developing apparatus is different. In the following description, the suffixes Y (yellow), M (magenta), C (cyan) and K (black), which are attached to each reference sign to indicate the color of the element, are omitted unless distinction is especially needed.

As a major configuration, each image forming station includes a photosensitive drum 1 (image bearing member), a charging roller 2 (charging unit), a developing apparatus 4, a primary transfer apparatus 51, and the like. An exposure apparatus 3 may be shared by each image forming station, or may be disposed in each image forming station. In the present embodiment, the photosensitive drum 1, the charging roller 2 and the developing apparatus 4 are integrated as a process cartridge 8, which is configured to be detachable from the image forming apparatus main unit (portion of the image forming apparatus 100 when the process cartridge 8 is removed). The process cartridge of the present invention, however, may include at least the photosensitive drum 1 and the developing apparatus 4, which are integrally detachable from the apparatus main unit. The developing apparatus 4 may be configured to be independently detachable from the apparatus main unit or from the process cartridge 8. Further, the photosensitive drum 1 and the developing apparatus 4 may be fixed to the image forming apparatus main unit so that replacement by the user is unnecessary.

Figure 4:
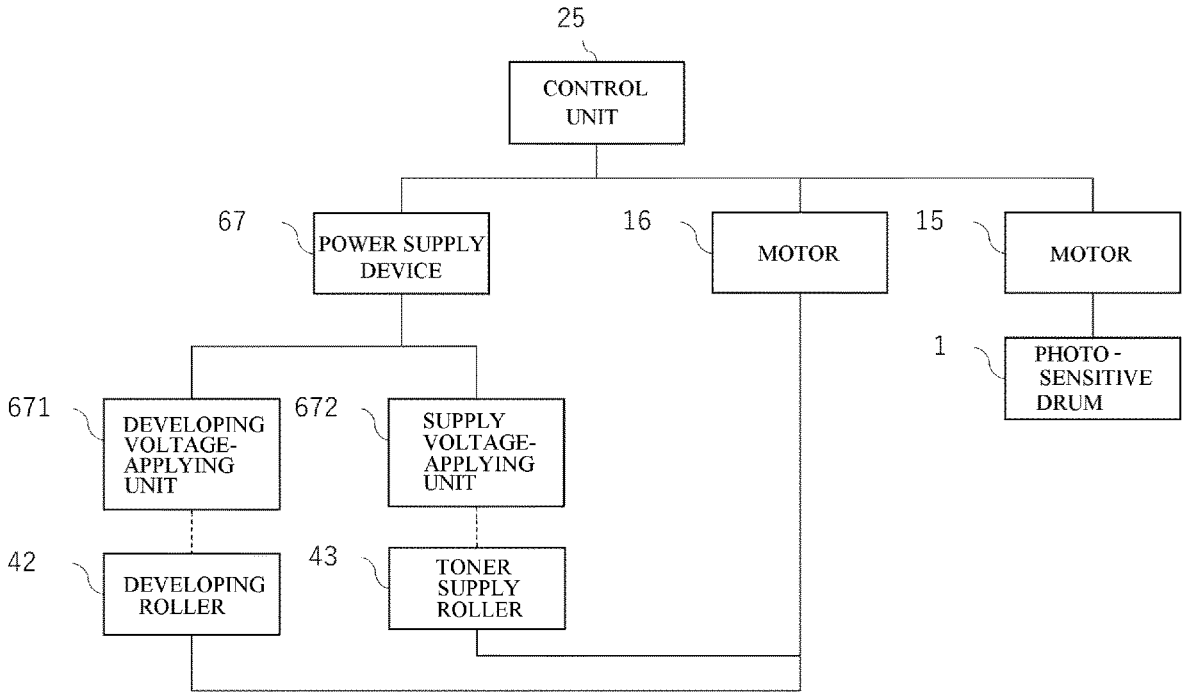
FIG. 4 is a diagram depicting control blocks of the image forming apparatus of Example 1.

The photosensitive drum 1 is a rotatable cylindrical photosensitive member, and rotates around the shaft thereof in the arrow direction (counterclockwise in FIG. 1). In the present embodiment, the outer peripheral surface thereof is rotary-driven at a 180 mm/sec rotation speed. For example, as indicated in FIG. 4, the photosensitive drum 1 is rotated by the rotary driving force of a motor 15, which is controlled by a control unit 25. The surface of the photosensitive drum 1 is uniformly charged by the charging roller 2. In the present embodiment, the charging roller 2 is a conductive roller having a conductive rubber layer formed on a core metal. The charging roller 2 is contacted with the photosensitive drum 1 in parallel at a predetermined pressure, and rotates as the photosensitive drum 1 rotates. A charging voltage can be applied to the charging roller 2 from a power supply device 67 (power supply unit). In the present embodiment, the photosensitive drum 1 is charged by applying a −1150V DC voltage to the charging roller 2, and the surface potential of the photosensitive drum 1 in this case is about −500V.

The exposure apparatus 3 (exposure unit) acquires an image signal from a control unit 65, and the surface of the photosensitive drum 1 is scanned with a laser light in accordance with the image signal. Thereby an electrostatic latent image in accordance with the image signal is formed on the charged photosensitive drum 1. The image signal may be acquired from an external information processor (not illustrated). For the control unit 65, an information processor, such as a control circuit which includes arithmetic resources (e.g. processor, memory), can be used, for example.

The developing apparatus 4 supplies toner 90 to the electrostatic latent image on the photosensitive drum 1, so that the electrostatic latent image becomes visible as a toner image (developer image). In the present embodiment, the developing apparatus 4 is a contact-developing type reversal-developing apparatus that contains toner 90 as a single component developer having a negative normal charging polarity (charging polarity for developing the electrostatic latent image).

The developing apparatus 4 includes a rotatable developing roller 42 (developing member), a toner supply roller 43 (developer supply member), and a regulating blade 44 (developer-regulating member). The toner supply roller 43 is an elastic sponge roller, in which a foam member is disposed on an outer periphery of the conductive core metal. The toner supply roller 43 is disposed so as to contact the developing roller 42 with a predetermined degree of pressure. The toner 90, which is supplied by the toner supply roller 43 and is held by the developing roller 42, has a layer thickness regulated by the regulating blade 44, and is provided for development processing. Here the regulating blade 44 not only has the function to regulate the layer thickness of the toner 90 on the developing roller 42, but also has a function of a developer charging unit that provides predetermined charges to the toner 90 on the developing roller 42.

The power supply device 67 can function as: a developing voltage-applying unit 671 that applies developing voltage to the developing roller 42 included in the developing apparatus 4; a supply voltage-applying unit 672 that applies supply voltage to the toner supply roller 43; and a regulating voltage-applying unit that applies the regulating voltage to the regulating blade 44. FIG. 4 indicates an example of a control system of the power supply device 67 related to the control by the control unit 25. For the power supply device 67, a charging power supply for the charging roller and a developing power supply for the developing apparatus may be independently disposed. In this case, collectively the charging power supply and the developing power supply may be regarded as the power supply unit. Further, the developing power supply for the developing roller and the power supply for the toner supply roller may be independently disposed. In this case, collectively the charging power supply, the developing power supply and the power supply for the toner supply roller may be regarded as the power supply unit. The power supply device 67 may be used for applying power when image transfer is performed. A transfer power supply may be disposed independently from the power supply device 67. The power supply device 67 of the present embodiment changes the voltage to be applied to each composing element in accordance with the control of the control unit 65.

The developing roller 42 is rotary-driven in the arrow direction (clockwise in FIG. 1), so that the surfaces of the developing roller 42 and the photosensitive drum 1 move in the same direction. For example, as indicated in FIG. 4, the developing roller 42 and the toner supply roller 43 are rotated by the rotary-driving force generated by a motor 16 that is controlled by the control unit 25. The developing roller 42 can rotate at a rotating speed that is different from the photosensitive drum 1. In the present embodiment, in order to acquire an appropriate image density, the developing roller 42 is rotary-driven such that the moving speed of the surface of the developing roller 42 is faster than the moving speed of the surface of the photosensitive drum 1. The developing apparatus 4 is pushed toward the photosensitive drum 1 by an energizing means (not illustrated), and as a result, the developing roller 42 is pressed against the photosensitive drum 1. Thereby the surface of the developing roller 42 is deformed, and a developing nip (developing portion) is formed, so as to perform stable development in a stable contact state.

Figure 2A:
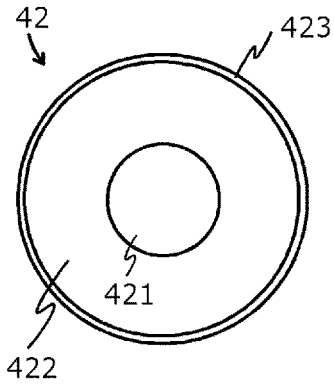
FIGS. 2A to 2C are diagrams depicting an example of a developing roller used for the image forming apparatus of Example 1, and a scraping operation thereof.
Figure 2B:
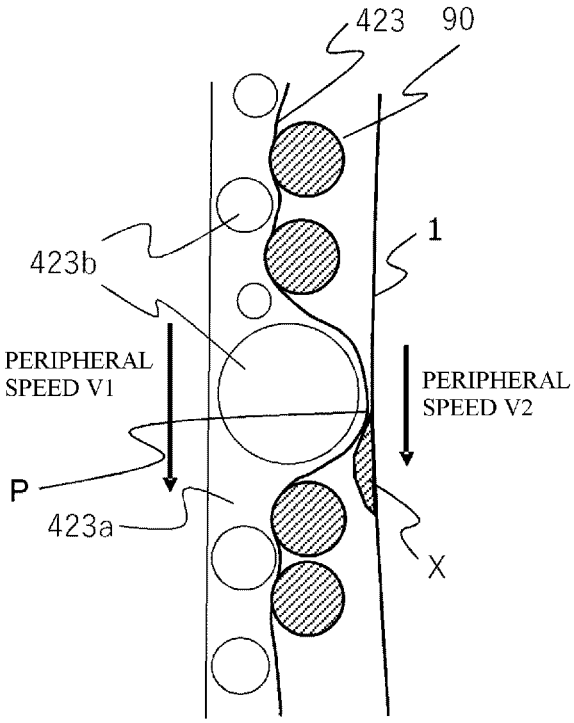

As illustrated in FIG. 2A, the developing roller 42 is constituted of a base layer 422 and a surface layer 423, which are formed on the outer periphery of the shaft center 421. Further, as illustrated in FIG. 2B, the surface layer 423 has a structure where coarse particles 423*b* are dispersed in a surface layer bonding resin 423*a*. Therefore a plurality of depressed portions and a plurality of protruded portions are formed on the surface of the surface layer 423 for transporting the toner. The ten-point average roughness RzJIS of the protruded portions is larger than the volume average particle size of the toner 90, and in the case of the present embodiment, the volume average particle size of the toner is 7 μm, and RzJIS of the surface layer 423 is 10 μm. The range of the RzJIS of the surface layer of the developing roller is preferably about 8 μm to 30 μm.

To measure the ten-point average roughness RzJIS of the developing roller 42 of the present invention, a contact type surface roughness meter, SurfCoder SE3500 (made by Kosaka Laboratory), can be used, for example. The measurement conditions used here are: a cut-off value of 0.8 mm; a measurement length of 2.5 mm; and a feed speed of 0.1 mm/sec. For each developing roller, three arbitrary prints, which are disposed at different locations in the longitudinal direction, are measured, and the average of the acquired measurement values is regarded as the RzJIS of the developing roller 42.

For the volume average particle size of the toner 90, a measurement value measured by the following method can be used. For the measurement device, the Coulter Multi-Sizer IV (made by Beckman Coulter) can be used. For the electrolytes, a high grade sodium chloride dissolved in deionized water to about 1% by mass, such as ISOTON II (made by Beckman Coulter), can be used. For the measurement method, 0.5 ml alkylbenzene sulfonic acid is added to a 100 ml electrolyte solution as the dispersant, and 10 mg of measurement sample is added thereto. Then dispersing processing is performed for 1 minute on electrolytes, in which the measurement sample is suspended, the volume particle size distribution is measured using a 30 μm aperture of the measurement device, and the median value (D50) of the measurement results is regarded are the volume average particle size.

The toner image formed on the photosensitive drum 1 is electrostatically transferred to an intermediate transfer belt 53 by the primary transfer apparatus 51, which is one of the transfer members. Each color of the toner image is sequentially transferred onto the intermediate transfer belt 53, so as to be superimposed with each other, whereby a full color toner image is formed. The full color toner image is then transferred to a recording material (transferred member) by a secondary transfer apparatus 52, which is another transfer member, and is different from the primary transfer apparatus 51. Then the toner image on the recording material is pressed and heated by a fixing apparatus 6, whereby the toner image is fixed to the recording material, and the recording material is discharged as an image formed product.

In the moving direction of the intermediate transfer belt 53, a belt cleaning device 7 is disposed on the downstream side of the secondary transfer apparatus 52, so as to remove and collect untransferred toner 90 remaining on the intermediate transfer belt 53.

In the present embodiment, an image bearing member-cleanerless system is used, in which untransferred toner 90 remaining on the surface of the photosensitive drum 1 is collected by the developing apparatus 4, without disposing a dedicated cleaner device for the photosensitive drum 1. This means that there is no member that contacts with the photosensitive drum 1, until the surface of the photosensitive drum 1, which passed the position facing the primary transfer apparatus 51 (primary transfer position), reaches the contact position with the charging roller 2 (charging position). Thereby when the developing roller 42 of the developing apparatus 4 is contacted with the photosensitive drum 1, untransferred toner 90 remaining on the photosensitive drum 1 after an image is formed, can be collected by the developing apparatus 4. In the case of using such a cleanerless system, it is preferable to use a non-magnetic single component developer for the toner 90. However, the present invention is not limited to the above mentioned configuration to implement the effect of the invention.

The image forming apparatus 100 includes a detection device (not illustrated) to detect a printing state and a printing environment. The control unit 65 can execute an image forming operation or a later mentioned scraping operation, which is an operation other than the image forming operation, in accordance with the detected printing state and printing environment.

Control

An operation of the image forming apparatus according to the present invention will be described. When an image is formed, −300V is applied to the developing roller 42. On the other hand, −400V is applied to the regulating blade 44, and −400V is also applied to the toner supply roller 43. Since the charging polarity of the toner 90 of the present invention is a negative charging polarity, toner can be easily supplied from the toner supply roller 43 to the developing roller 42.

In the photosensitive drum 1, it is controlled such that the surface potential of an image printing portion where a toner image is formed is on the side of the normal charging polarity of the toner 90, and the absolute value of the surface potential becomes lower than the applied voltage to the developing roller 42. In a non-image printing portion where a toner image is not formed, on the other hand, the surface potential is controlled to the drum potential of −500V. Thereby in the image printing portion, toner, charged by the potential difference from the developing roller 42, is developed.

The toner image developed on the photosensitive drum is transferred to the intermediate transfer belt 53 in a primary transfer portion formed by the primary transfer apparatus 51, but toner with a low charging level or toner charged with an opposite polarity of normal charging polarity, is not transferred and enters between the charging roller 2 and the photosensitive drum 1. Toner causing fogging also enters between the charging roller 2 and the photosensitive drum 1.

As a result, stress may be applied to the toner between the charging roller 2 and the photosensitive drum 1, and the toner may be deformed and adhere to the photosensitive drum 1. In a portion of the photosensitive drum where toner adheres (indicated by the X sign), transferability is lower in the next image formation, which means that untransferred toner is even more easily generated, and grows as an adhered substance on the photosensitive drum.

On the portion of the photosensitive drum where melted toner adheres, a laser beam emitted from the exposure apparatus 3 is blocked, hence the surface potential of the photosensitive drum 1 does not reach a predetermined potential, and the image density drops in the solid printing portion. Especially if the melted toner is continuously adhered in the rotating direction of the photosensitive drum, white streaks are generated in the image. To prevent this, it is necessary to remove toner remaining on the photosensitive drum.

Melt Adhesion Scraping Operation

An operation to prevent the growth of the melt adhered substance on the drum according to the present embodiment will be described. Each voltage, in the image forming operation, is as follows.

Apply voltage V_DEV to developing roller 42: −300V

Apply voltage V_S to the toner supply roller 43: −400V

In other words, the absolute value of the developing voltage is smaller than the absolute value of the supply voltage in the image forming operation. Therefore the difference of the apply voltages between the toner supply roller 43 and the developing roller 42 is −100V. In the present embodiment, the normal charging polarity of the toner is negative, hence the potential difference V_DIFF that is generated as the driving force supplied from the toner supply roller 43 to the developing roller 42 is as follows.

Potential difference V_DIFF: +100V

When the image forming operation on the intermediate transfer belt 53 ends for each printing job, the control unit 65 changes the apply voltage V_S to the toner supply roller 43 from −400V, which is a value used for image formation, to −350V, and allows the toner supply roller 43 to rotate for a predetermined time. Thereby the potential difference V_DIFF changes from 100V to 50V, that is, the pressing force on the toner from the toner supply roller 43 to the developing roller 42 becomes weaker than the time of image formation, and the toner amount on the developing roller decreases compared to the time of image formation. In other words, the potential difference in the case of the scraping operation is smaller than in the case of the image forming operation. Hereafter, this control to decrease the potential difference V_DIFF to be smaller than the case of image formation, so that the developing roller 42 and the photosensitive drum 1 contact and rotate in this state, is referred to as the "scraping operation". The "scraping operation" referred to here is given as a preferable example of the "cleaning operation" for cleaning the toner on the photosensitive drum 1.

For the potential relationship, the apply voltage to the toner supply roller 43 may be set to −250V when the scraping is performed, so that the potential difference V_DIFF becomes −50V, and the toner can be returned from the developing roller 42 to the toner supply roller 43 side. When the image forming operation is performed, the absolute value of the developing voltage may be set to be smaller than the absolute value of the supply voltage, and when the scraping operation is performed, the potential difference of the developing voltage and the supply voltage may be set to zero. Or when the image forming operation is performed, the absolute value of the developing voltage may be set to the absolute value of the supply voltage or less, and when the scraping operation is performed, the absolute value of the developing voltage may be set to be larger than the absolute value of the supply voltage.

In the case where the normal charging polarity of the toner is positive, the apply voltage to the developing roller 42 may be set to +300V and the apply voltage to the toner supply roller 43 may be set to +400V when the image forming operation is performed, and the apply voltage to the toner supply roller 43 may be changed to +350V when the scraping operation is performed, for example.

The end of the image forming operation on the intermediate transfer belt 53 refers to the timing at which the rear end of the image at each image forming station is transferred to the intermediate transfer belt. In the present embodiment, the scraping operation is simultaneously started at all the image forming stations Y, M, C and K to simplify the control. For this reason, the timing of the change is a timing at which the rear end of the image at the image forming station K, which is located on the far downstream side, is transferred to the intermediate transfer belt 53. However, the scraping operation may be started sequentially from the image forming station located upstream of which image forming operation ended.

Figure 3:
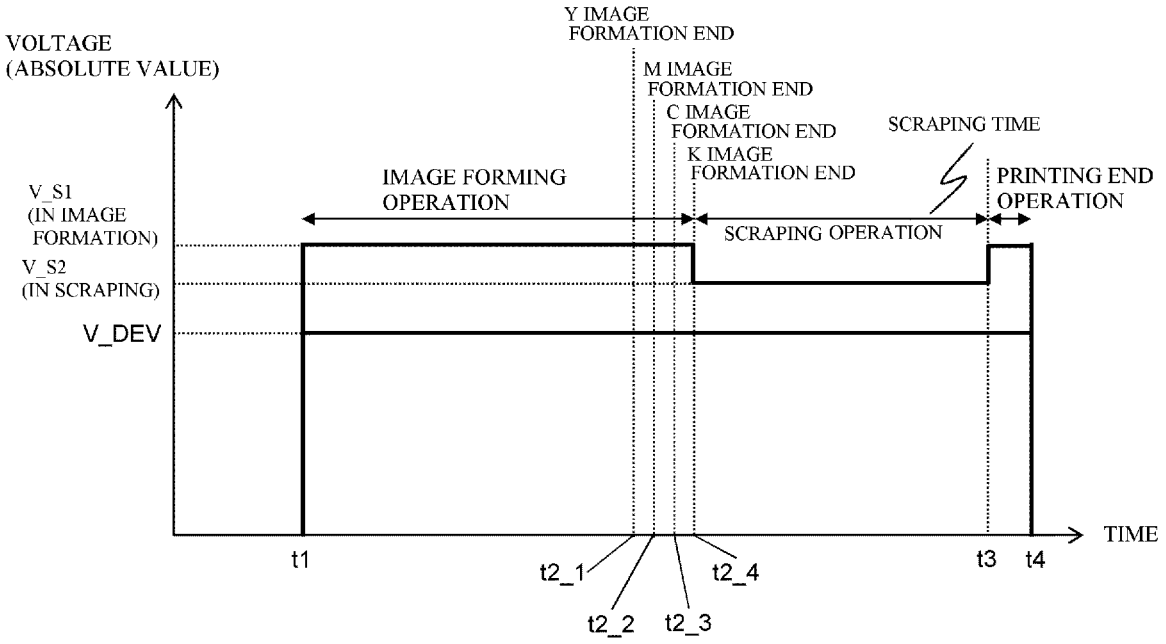
FIG. 3 is a diagram indicating a melt adhesion scraping control that is used for the image forming apparatus of Example 1.

FIG. 3 is a time chart in the case where the scraping operation of each image forming station is started simultaneously. The abscissa indicates the elapse of time. The ordinate indicates the absolute value of voltage, and indicates the apply voltage V_DEV to the developing roller 42, the apply voltage V_S1 to the toner supply roller 43 in image formation, and the apply voltage V_S2 to the toner supply roller 43 in the scraping.

The image forming operation starts at timing t1, and the apply voltage to the toner supply roller 43 is set to V_S1. Then at the timings t2_1 to t2_4, formation of the Y image, M image, C image and K image sequentially end. At timing t2_4, the scraping operation simultaneously starts at each image forming station, and the apply voltage to the toner supply roller 43 is changed to V_2. At timing t3, when a predetermined scraping time has elapsed, the scraping operation ends. Then the printing end operation starts, and the printing end operation ends at t4.

Here the meaning of the scraping operation will be described. In the case where the apply voltage V_S to the toner supply roller 43 in the image formation is on the supply side (in the case of apply voltage difference V_DIFF>0), as in the case of the present embodiment, it becomes more difficult for the toner to be supplied to the developing roller 4 and the supply amount decreases if the apply voltage V_S to the toner supply roller 43 in the scraping operation becomes closer to the apply voltage of the developing roller 42 than to the apply voltage V_S in the image formation. As a result, the amount of toner on the developing roller decreases, and the depressed/protruded portions on the surface of the developing roller 42 directly contact the photosensitive drum 1 more easily.

Figure 2C:
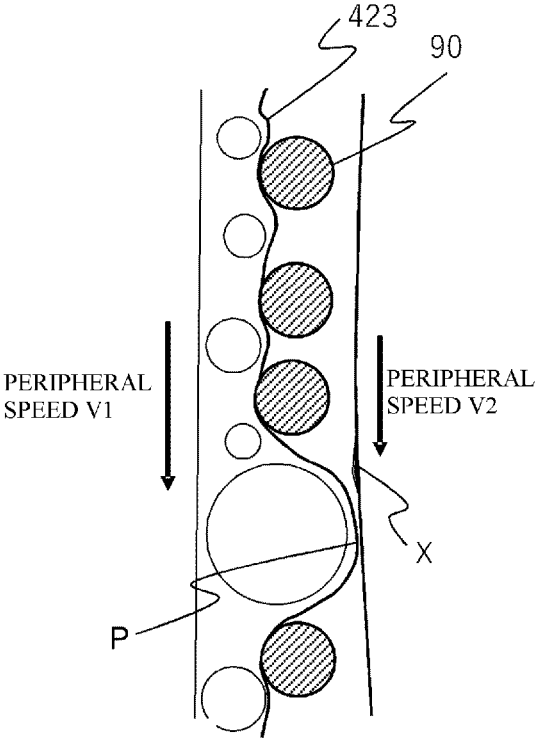

For example, if the apply voltage V_S to the toner supply roller 43 is changed from −400V to −350V, the toner on the developing roller decreases, and a part of the surface layer of the developing roller is exposed from the toner coated on the developing roller 42 after the regulating blade 44 passes. FIG. 2B indicates a state immediately before the portion (exposed portion P in FIGS. 2B and 2C), which is exposed from the toner coating the protruded portions of the surface layer of the developing roller, and the protruded portions scrape off the substance X that melted and adhered to the photosensitive drum. FIG. 2C indicates a state immediately after the exposed portion P scraped most of the substance X that melted and adhered to the photosensitive drum. Here when the peripheral speed of the developing roller 42 is V1 and the peripheral speed of the photosensitive drum 1 is V2, V1 and V2 have a peripheral speed difference, and is V1>V2 in the present embodiment. In this way, the substance that melted and adhered to the photosensitive drum can be scraped off if the portion exposed from the toner coating on the surface layer of the developing roller contacts with the photosensitive drum 1, and rotates at a peripheral speed different from the peripheral speed of the photosensitive drum 1. This operation of the developing roller 42 scraping and removing the toner 90 on the photosensitive drum 1 is referred to as the "scraping operation". Hereafter, a capability of scraping the toner 90 on the photosensitive drum 1 in the scraping operation is referred to as the "scraping force". The "scraping force" referred to here is given as a preferable example of the "cleaning force" when cleaning the toner on the photosensitive drum 1. The control unit can increase the scraping force to increase the amount of the toner to be scraped, or decrease the scraping force to decrease the amount of the toner to be scraped, by controlling voltage to be applied to each composing element, for example, as described later.

In the present embodiment, the apply voltage V_S to the toner supply roller 43 in the scraping operation is changed to −350V for all the image forming stations, but the apply voltage V_S may be controlled for each image forming station.

Further, in the present embodiment, the apply voltage V_S to the toner supply roller, that is, −400V in the image formation, is changed to −350V in the scraping. However, the present invention is not limited to this, and it is sufficient if the exposed portions P are formed by performing control to decrease the potential difference V_DIFF. For example, the apply voltage V_DEV to the developing roller 42 may be changed while the apply voltage V_S to the toner supply roller 43 is fixed, or both the apply voltage V_S to the toner supply roller 43 and the apply voltage V_DEV to the developing roller 42 may be changed.

Then in the state where the apply voltage V_S to the toner supply roller 43 is lowered than in the image formation, the developing roller 42 and the photosensitive drum 1 are contacted and rotated to perform the scraping operation for a predetermined time, and then the developing roller 42 is separated from the photosensitive drum 1, and the printing end operation is performed.

Details of Example 1

As indicated in Table 1, Examples 1-1 to 1-5 and Comparative Examples 1-1 to 1-3 are the results when a printing operation was performed for 6000 prints as follows, with combining various printing conditions, then formed solid black images were evaluated. The peripheral speed difference between the peripheral speed V1 of the surface of the developing roller and the peripheral speed V2 of the surface of the photosensitive drum is 70 mm/s.

Printing environment (room temperature): 15° C. to 30° C.
Number of prints per job: 1 print/2 prints
Apply voltage V_S to toner supply roller 43: −400V/−350V
Apply voltage change time (scraping time after each job): 1.1 s to 6 s For the image quality, the result of determining the degree of white streaks caused by melt adhesion is indicated in "Melt adhesion white streak result" in Table 1. Here ○ indicates no problem, A indicates minor white streaks causing no practical problem, and x indicates white streaks causing a problem. The scraping force can be increased if the scraping time is extended, but extending the scraping time without limit accelerates the deterioration of toner in contact portions between the regulating blade 44 or the developing roller 42 and the photosensitive drum 1, and generates unevenness in the solid black images in the latter half of the durability test. This result is indicated in "Development deterioration result" in Table 1. Here ○ indicates no problem, and x indicates that development deterioration is observed.

TABLE 1

| | Example 1-1 | Example 1-2 | Example 1-3 | Example 1-4 | Example 1-5 | Comparative Example 1-1 | Comparative Example 1-2 | Comparative Example 1-3 |
|---|---|---|---|---|---|---|---|---|
| Printing environment | 15° C. | 15° C. | 15° C. | 23° C. | 30° C. | 15° C. | 15° C. | 15° C. |
| Number of prints per job | 1 | 2 | 2 | 2 | 2 | 1 | 2 | 2 |
| Apply voltage to supply roller | −350 V | −350 V | −350 V | −350 V | −400 V | −350 V | −400 V | −350 V |
| Apply voltage change time | 1.8 s | 2.5 s | 1.8 s | 1.6 s | 1.1 s | 1.5 s | 2.5 s | 6 s |
| Melt adhesion white streak result | ○ | ○ | Δ | ○ | ○ | x | x | ○ |
| Development deterioration result | ○ | ○ | ○ | ○ | ○ | ○ | ○ | x |

Description of Examples 1-1 to 1-3

In Example 1-1, a number of prints per job is 1, apply voltage V_S to the toner supply roller 43 is −350V, and scraping time is 1.8 seconds. In Example 1-2, a number of prints per job is 2, and scraping time is 2.5 seconds. In Example 1-3, a number of prints per job is 2, and scraping time is 1.8 seconds. The printing environment room temperature of the Examples 1-1 to 1-3 is 15° C.

According to the comparison of Example 1-1 and Example 1-3, minor blank dots are generated if a number of prints per job is high, even if scraping time is the same. This is because the interval between the scraping operations increases, and more melted and adhered substance accumulated. In the case where the number of prints per job is 2, the growth of the melted and adhered substance can be suppressed if the scraping time is increased to 2.5 seconds or more, as indicated in Example 1-2.

Description of Examples 1-4 and 1-5

Now a case where the specified printing environment is relatively high temperature will be considered. In Example 1-4, the apply voltage change time is set to 1.6 seconds when the specified printing environment room temperature is 23° C. In Example 1-5, the specified printing environment room temperature is 30° C. In the case of Example 1-5, when the scraping is performed after the image formation, constant rotation is maintained without changing the apply voltage V_S to the toner supply roller 43 from that at the image formation, and the scraping time is set to 1.1 seconds.

According to the comparison of Examples 1-3 to 1-5, the scraping time required for suppressing melt adhesion becomes long if the temperature in the printing environment becomes low. This is because in a low temperature environment, deformation followability of the charging roller is reduced and stronger stress is applied to the toner, which makes toner deformed and melt adhesion more easily occurs. In Example 1-5 in which temperature is especially high, on the other hand, white streaks can be suppressed with a short scraping time, even if the apply voltage V_S to the toner supply roller 43 is not changed.

Description of Comparative Example 1-1

Each comparative example will now be described. In Comparative Examples 1-1 to 1-3, the specified printing environment room temperature is 15° C. In Comparative Example 1-1, the scraping time is 1.5 seconds, and the rest of the conditions are the same as Example 1-1. A comparison of Example 1-1 and Comparative Example 1-1 indicates that the generation of melt adhesion can be suppressed if the scraping time is increased. This is because the distance in which the developing roller 42 and the photosensitive drum 1 rub each other increases in a state where the apply voltage difference V_DIFF between the developing roller 42 and the toner supply roller 43 is decreased, and the effect of scraping the melted substance adhered to the photosensitive drum can be increased. In order to scrape each portion of the photosensitive drum 1 in the circumferential direction, at least a time for the photosensitive drum 1 to make one rotation is required for the scraping time for one scraping operation.

Description of Comparative Example 1-2

In Comparative Example 1-2, a number of prints per job is 2, the apply voltage V_S to the toner supply roller 43 is the same as that in the image formation, and the scraping time is 2.5 seconds, which is the same as Example 1-2. Comparison of Example 1-2 and Comparative Example 1-2 indicates that white streaks, due to melt adhesion, are generated if the apply voltage V_S to the toner supply roller 43 in the scraping is not changed from that in the image formation.

Description of Comparative Example 1-3

In Comparative Example 1-3, a number of prints per job is 2, and the scraping time is 6 seconds. The scraping force is sufficient but the developing rotation time per job becomes long, hence the time when the toner is rubbed inside the developing portion and at the contact portion of the developing roller 42 and the photosensitive drum 1 becomes long. As a result, the toner deteriorates and unevenness is generated in the solid black image.

As described above, in a state where the photosensitive drum 1 and the developing roller 42 have a peripheral speed difference, the voltages to be applied to the developing roller 42 and the toner supply roller 43, the scraping time (contact-rotation time) and other conditions, are set in accordance with the printing environment and the conditions of the printing job, then the scraping operation is performed, thereby the portions exposed from the toner coat on the surface of the developing roller can remove the melted substance that adhered to the surface of the photosensitive drum.

Example 2

Example 2 will be described. Description is omitted for portions that same as Example 1. In Example 2, when a number of prints per job is high, the apply voltage V_S to the toner supply roller 43 is changed in order to increase the scraping force. Specifically, when the scraping operation is performed, the potential difference V_DIFF of the apply voltage between the developing roller 42 and the toner supply roller 43 in the direction of pressing toner from the toner supply roller 43 to the developing roller 42 is decreased as a number of prints per job is higher. For example, when the potential difference V_DIFF in the image formation is +100V, V_DIFF is set to +50V if the number of prints per job is 2, and is set to 0V if the number of prints per job is 3. As the potential difference V_DIFF decreases, the toner amount on the developing roller decreases, and the depressed/protruded portions on the surface of the developing roller 42 are exposed even more, that means that the scraping force increases.

The test result of Example 2 is indicated in Table 2. In Example 2, the scraping time is a constant 1.8 seconds. The peripheral speed difference between the surface of the developing roller and the surface of the photosensitive drum is 70 mm/s. The specified printing environment room temperature is 15° C.

TABLE 2

| | Example 2-1 | Example 2-2 | Example 2-3 | Comparative Example 2-1 |
|---|---|---|---|---|
| Number of prints per job | 2 | 2 | 3 | 3 |
| Apply voltage to supply roller | −350 V | −300 V | −300 V | −350 V |
| Melt adhesion white streak result | Δ | ○ | Δ | X |

Details of Example 2

In Example 2-1, a number of prints per job is 2, the apply voltage to the toner supply roller 43 at the scraping is set to −350V, and the scraping operation is performed for 1.8 seconds after each job ends (same conditions as Example 1-3). In Example 2-2, the apply voltage to the toner supply roller in the scraping is set to −300V. In Example 2-3, a number of prints per job is 3, and the apply voltage in the scraping is −300V.

Details of Comparative Example 2

In Comparative Example 2-1, a number of prints per job is 3, and the apply voltage to the toner supply roller 43 in the scraping is set to −350V. Compared with Example 2-1, a number of prints per job is higher.

Comparison of Example 2 and Comparative Example 2

As a comparison of Example 2-1 and Example 2-2 indicates, a minor melt adhesion occurs to the image in the case of V_S=−350V (potential difference V_DIFF=+50V), but no melt adhesion occurs to the image in the case of V_S=−300V (potential difference V_DIFF=0V). By decreasing the potential difference V_DIFF generated between the developing roller 42 and the toner supply roller 43, the scraping force can be further increased.

As the comparison of Example 2-1 and Example 2-3 indicates, if the apply voltage V_S to the toner supply roller 43 in the scraping is changed from −350V to −300V to increase the scraping force, the minor melt adhesion state can be maintained for the images even if the number of prints per job is increased from 2 to 3.

On the other hand, the comparison of Example 2-1 and Comparative Example 2-1 indicates that if the apply voltage V_S to the toner supply roller 43 in the scraping is not changed from −350V, the white streaks on the image due to melt adhesion worsen when the number of prints per job is increased from 2 to 3.

Example 3

Example 3 will be described. Description is omitted for portions the same as Examples 1 and 2. In Example 3, when a number of prints per job is high, the peripheral speed difference between the developing roller 42 and the surface of the photosensitive drum is increased to be higher than that in the image formation, and the surface distance is increased, in order to increase the scraping force. Specifically, as a number of prints per job is higher, the peripheral speed difference between the developing roller 42 and the photosensitive drum 1 in the scraping operation is increased.

The test result of Example 3 is indicated in Table 3. The scraping time is a constant 1.8 seconds, and the apply voltage V_S to the toner supply roller 43 at the scraping is always −350V. The specified printing environment room temperature is 15° C.

TABLE 3

| | Example 3-1 | Example 3-2 | Example 3-3 | Comparative Example 3-1 |
|---|---|---|---|---|
| Number of prints per job | 2 | 2 | 3 | 3 |
| Peripheral speed difference between developing roller and photosensitive drum | 70 mm/s | 120 mm/s | 120 mm/s | 70 mm/s |
| Melt adhesion white streak result | Δ | ○ | Δ | X |

Details of Example 3

In Example 3-1, a number of prints per job is 2, and white streaks generated due to melt adhesion, when the developing roller 42 and the photosensitive drum 1 are rotated at the peripheral speed difference 70 mm/s (developing roller is rotating faster) in the scraping, are indicated. Here only minor white streaks, create no practical problem, were generated in the images. Example 3-2 indicates a result of the white streaks generated due to melt adhesion when the peripheral speed difference is 120 mm/s. In Example 3-2, no white streaks were generated. Example 3-3 indicates a result when the peripheral speed difference is 120 mm/s and a number of prints per job is 3. In Example 3-3, the white streaks generated due to melt adhesion were at a minor level.

Details of Comparative Example 3

In Comparative Example 3-1, the peripheral speed difference between the developing roller 42 and the photosensitive drum 1 is 70 mm/s, and a number of prints per job is 3 (same as Comparative Example 2-1). In the case of Comparative Example 3-1, white streaks generated due to melt adhesion were observed.

Comparison of Example 3 and Comparative Example 3

As a comparison of Example 3-1 and Example 3-2 indicates, the scraping force can be increased by increasing the peripheral speed difference. Further, as the comparison of Example 3-1 and Example 3-3 or the comparison of Example 3-1 and Comparative Example 3-1 indicates, as a number of prints per job increases, the peripheral speed difference needs to be increased to increase the scraping force.

Example 4

The present invention can be suitably executed by the control unit 65 setting appropriate operation conditions in accordance with the pre-conditions, such as the printing environment and the printing job setting, and operating each composing element of the image forming apparatus. For this, it is preferable to store a table or mathematical formulae in advance, in which pre-conditions (e.g. printing environment, printing job setting) and operation settings (e.g. apply voltage, scraping time, peripheral speed difference) are linked, in a memory or the like. The control unit 65 acquires printing job setting information based on the printing job instructed by the user, refers to the memory using the printing job setting as a key, and sets appropriate operation conditions.

It is more preferable that the image forming apparatus includes an environment information acquisition unit 69. The control unit 65 refers to the memory using the printing environment information detected by the environment information acquisition unit 69 as a key, and sets appropriate operation conditions. The environment information acquisition unit 69 may include a thermometer.

As described above, according to each example of the present invention, such operation conditions as the voltages applied to the developing roller 42 and the toner supply roller 43 respectively, the scraping time (contact-rotation time) and the peripheral speed difference between the photosensitive drum 1 and the developing roller 42, are set according to such pre-conditions (printing conditions) as the printing environment (room temperature) and the printing job setting (number of prints per job), and the scraping operation is performed based on the operation conditions. Thereby the exposed portions P are formed on the surface of the developing roller, and the melted substance that adhered to the surface of the photosensitive drum can be removed. Particularly in a cleanerless type image forming apparatus, which does not include a cleaning blade to remove the toner 90 remaining on the photosensitive drum 1, executing the scraping operation described in the present embodiment is very effective to remove adhered substances. As long as the melted substance that adhered to the surface of the photosensitive drum 1 can be removed, combinations of the conditions to be set are not limited to each example described above, and may be set in any combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-069612, filed Apr. 16, 2021, which is hereby incorporated by reference wherein in its entirety.

What is claimed is:

1. An image forming apparatus comprising:

an image bearing member configured to be rotatable;

an exposure unit configured to expose a surface of the image bearing member to form an electrostatic latent image on the surface of the image bearing member;

a developing member configured to be rotatable, which contacts with the image bearing member to form a developing portion, and supplies developer to the surface of the image bearing member in the developing portion, and which rotates at a rotation speed different from a rotation speed of the image bearing member;

a developer supply member configured to supply developer to the surface of the developing member;

a developing voltage-applying unit configured to apply developing voltage to the developing member;

a supply voltage-applying unit configured to apply supply voltage to the developer supply member; and a control unit configured to control the developing voltage-applying unit and the supply voltage-applying unit, wherein the control unit controls to be capable of executing an image forming operation in which a developer image is formed on the surface of the image bearing member by supplying the developer from the developing member to the electrostatic latent image formed on the surface of the image bearing member; and a cleaning operation, which is an operation other than the image forming operation and which removes a substance adhered to the surface of the image bearing member, using the developing member, in the case of executing the cleaning operation, the control unit controls at least one of the developing voltage-applying unit and the supply voltage-applying unit so that the cleaning force to clean the substance adhered to the surface of the image bearing member using the developing member becomes stronger than that in the case of executing the image forming operation, and in the case of executing the cleaning operation, the control unit controls at least one of the developing voltage-applying unit and the supply voltage-applying unit so that the supply amount of the developer supplied from the developer supply member to the developing member decreases compared with the case of executing the image forming operation.

2. The image forming apparatus according to claim 1, wherein the control unit can increase the amount of adhered substance to be cleaned off as the cleaning force for the developing member to clean the adhered substance on the surface of the image bearing member is stronger.

3. The image forming apparatus according to claim 2, wherein in the case of executing the cleaning operation, the control unit controls at least one of the developing voltage-applying unit and the supply voltage-applying unit so that an exposed portion exposed from the developer is formed, and allows the developing member in which the exposed portion is formed to rub against the image bearing member.

4. The image forming apparatus according to claim 1, wherein when a direction in which the normally charged developer is supplied from the developer supply member to the developing member is positive, and a direction in which the developer is collected from the developing member to the developer supply member is negative, in terms of controlling the potential difference between the developer supply member and the developing member, in the case of executing the cleaning operation, the control unit controls at least one of the developing voltage-applying unit and the supply voltage-applying unit so that the potential difference decreases in the positive direction compared with the image forming operation, or the potential difference becomes zero, or the potential difference decreases in the negative direction.

5. The image forming apparatus according to claim 1, wherein the control unit controls the polarities of the supply voltage and the developing voltage to be the same polarity as the normal charging polarity of the developer, controls the absolute value of the developing voltage to be smaller than the absolute value of the supply voltage in the case of executing the image forming operation, and controls the potential difference between the developing voltage and the supply voltage to be smaller than that of the image forming operation in the case of executing the cleaning operation.

6. The image forming apparatus according to claim 1, wherein the control unit controls the polarities of the supply voltage and the developing voltage to be the same polarity as the normal charging polarity of the developer, controls the absolute value of the developing voltage to be smaller than the absolute value of the supply voltage in the case of executing the image forming operation, and controls the potential difference between the developing voltage and the supply voltage to be zero in the case of executing the cleaning operation.

7. The image forming apparatus according to claim 1, wherein the control unit controls the polarities of the supply voltage and the developing voltage to be the same polarity as the normal charging polarity of the developer, controls the absolute value of the developing voltage to be the absolute value of the supply voltage or less in the case of executing the image forming operation, and controls the absolute value of the developing voltage to be larger than the absolute value of the supply voltage in the case of executing the cleaning operation.

8. The image forming apparatus according to claim 1, further comprising a transfer member configured to transfer the developer on the image bearing member to a transferred member, wherein the developer that remains on the surface of the image bearing member without being transferred by the transfer member is collected by the developing member.

9. The image forming apparatus according to claim 1, wherein the developer is a non-magnetic single component developer.

10. The image forming apparatus according to claim 1, wherein a plurality of depressed portions and protruded portions are formed on the surface layer of the developing member to transport the developer, and when the cleaning operation is executed, the control unit controls such that at least the protruded portions, out of the depressed portions and the protruded portions, are exposed from the developer.

11. The image forming apparatus according to claim 10, wherein the ten-point average roughness of the protruded portions on the surface layer of the developing member is larger than the volume average particle size of the developer.

12. The image forming apparatus according to claim 10, wherein the ten-point average roughness of the protruded portions on the surface layer of the developing member is in an 8 μm to 30 μm range.

13. An image forming apparatus comprising:

an image bearing member configured to be rotatable;

an exposure unit configured to expose a surface of the image bearing member to form an electrostatic latent image on the surface bearing member;

a developing member configured to be rotatable, which contacts with the image bearing member to form a developing portion, and supplies developer to the surface of the image bearing member in the developing portion, and which rotates at a rotation speed different from a rotation speed of the image bearing member;

a developer supply member configured to supply developer to the surface of the developing member;

a developing voltage-applying unit configured to apply developing voltage to the developing member;

a supply voltage-applying unit configured to apply supply voltage to the developer supply member; and a control unit configured to control the developing voltage-applying unit and the supply voltage-applying unit, wherein the control unit controls to be capable of executing an image forming operation in which a developer image is formed on the surface of the image bearing member by supplying the developer from the developing member to the electrostatic latent image formed on the surface of the image bearing member; and a cleaning operation, which is an operation other than the image forming operation and which removes a substance adhered to the surface of the image bearing member, using the developing member, in the case of executing the cleaning operation, the control unit controls at least one of the developing voltage-applying unit and the supply voltage-applying unit so that the cleaning force to clean the substance adhered to the surface of the image bearing member using the developing member becomes stronger than that in the case of executing the image forming operation, and the control unit is capable of changing the cleaning force in the cleaning operation.

14. The image forming apparatus according to claim 13, wherein the control unit increases the cleaning force by increasing the time of the cleaning operation.

15. The image forming apparatus according to claim 13, wherein the control unit increases the cleaning force by increasing the peripheral speed difference between the image bearing member and the developing member.

16. The image forming apparatus according to claim 13, wherein the control unit is capable of changing the cleaning force in the cleaning operation, and in the case of control to decrease the potential difference between the supply voltage and the developing voltage compared with the image forming operation in the cleaning operation, the control unit increases the cleaning force by either decreasing the potential difference or setting the potential difference to zero, and in the case of control to set the potential difference in the negative direction in the cleaning operation, the control unit increases the cleaning force by increasing the potential difference in the negative direction.

17. The image forming apparatus according to claim 13, wherein the control unit controls to increase the cleaning force as a number of prints per job is higher in the image forming operation.

18. The image forming apparatus according to claim 13, further comprising an environment information acquisition unit configured to detect printing environment information of the image forming apparatus, and the control unit controls the cleaning force in accordance with the printing environment information.

19. The image forming apparatus according to claim 18, wherein the environment information acquisition unit acquires temperature as the printing environment information, and the control unit increases the cleaning force as the temperature lowers.

* * * * *